US005272813A

United States Patent [19]

Wolf et al.

[11] Patent Number: 5,272,813

[45] Date of Patent: Dec. 28, 1993

[54] PORTABLE HANDHELD WORK APPARATUS

[75] Inventors: Günter Wolf, Oppenweiler; Herbert Armbruster, Remseck; Reinhold Fink, Fellbach, all of Fed. Rep. of Germany

[73] Assignee: Andreas Stihl, Waiblingen, Fed. Rep. of Germany

[21] Appl. No.: 961,337

[22] Filed: Oct. 15, 1992

[30] Foreign Application Priority Data

Oct. 19, 1991 [DE] Fed. Rep. of Germany ..... 9113043
Oct. 2, 1992 [DE] Fed. Rep. of Germany ..... 9213272

[51] Int. Cl.[5] ..... B26B 27/00

[52] U.S. Cl. ..... 30/298.4; 30/296.1; 30/381

[58] Field of Search ..... 30/298.4, 296.1, 383, 30/382, 381

[56] References Cited

U.S. PATENT DOCUMENTS

| | | | |
|---|---|---|---|
| 1,210,770 | 1/1917 | Depollier | 30/298.4 |
| 3,886,658 | 6/1975 | Wikoff | 30/296.1 |
| 4,654,970 | 4/1987 | Nagashima | 30/383 |
| 4,658,507 | 4/1987 | Hazen | 30/382 |
| 4,841,641 | 6/1989 | Laidlaw | 30/382 |
| 5,101,567 | 4/1992 | Cool | 30/383 |

*Primary Examiner*—Richard K. Seidel
*Assistant Examiner*—Hwei-Siu Payer
*Attorney, Agent, or Firm*—Walter Ottesen

[57] ABSTRACT

The invention is directed to a portable handheld work apparatus such as a motor-driven chain saw. The work apparatus includes a housing having a forward end wall, a rearward end wall defining a plane and a top wall extending between the end walls. A handle is mounted on the top wall for holding and guiding the work apparatus. A work tool is arranged on the forward end wall and a drive motor is mounted in the housing for driving the work tool. A holding lug is provided on the rearward end wall and is pivotable between a rest position wherein the holding lug is recessed in a recess formed in the rearward end wall and an in-use position wherein the holding lug is outside of the recess. The holding lug defines an eyelet through which an operator can pass a rope for holding the work apparatus by attaching the same to a belt or the like thereby freeing the hands of the operator. The holding lug does not constitute a disturbance for the operator when supporting the work apparatus on the body with said rearward end wall.

19 Claims, 4 Drawing Sheets

13
24
1
23
17a
17
A
A
a
16
18
21
25
19
33
22
26
27
34
30
28
32
30
19
28
30
35
30
27
29

PORTABLE HANDHELD WORK APPARATUS

FIELD OF THE INVENTION

The invention relates to a portable handheld work apparatus such as a motor-driven chain saw. The work apparatus has a housing with a motor mounted therein for a work tool positioned at the front end of the housing. The work apparatus also has a handle mounted on top of the housing for holding and guiding the apparatus.

BACKGROUND OF THE INVENTION

Motor-driven chain saws of this kind are referred to as so-called top-handle chain saws which are especially utilized in caring for trees. The operator of the chain saw climbs into the tree requiring care or the operator must change position in the tree while having only one hand free since the other hand must hold the chain saw. In use, the chain saw is often braced on the thigh of the operator with the rearward end of the housing in order to perform a cutting operation without endangering the operator.

SUMMARY OF THE INVENTION

It is an object of the invention to improve the work apparatus described above to enable the operator to take the work apparatus to the work site without using the hands and without affecting manipulation of the work apparatus.

The portable handheld work apparatus of the invention is a work apparatus such as a motor-driven chain saw and includes: a housing having a forward end wall, a rearward end wall defining a plane and a top wall extending between the end walls; a handle mounted on the top wall for holding and guiding the work apparatus; a drive motor mounted in the housing; a work tool arranged at the forward end wall; a holding lug to permit holding the work apparatus by an operator; recess means in the rearward end wall for receiving the holding lug therein; and, pivot means for pivotally mounting the holding lug on the rearward end wall so as to be pivotable about a pivot axis between a rest position wherein the holding lug is recessed in the recess means at least largely below the plane and an in-use position outside of the recess means.

The arrangement of the lug on the rearward end face of the housing facing away from the work tool makes it possible for the operator to attach the lug to a spring hook on the belt or to pull an appropriate rope through in order to carry the work apparatus. In this way, the operator has both hands free in order to climb a tree.

At the work site, the operator releases the holding lug from the spring hook or from the rope and folds the lug about its pivot axis into its rest position wherein the lug is brought into the plane of the housing and lies in a recess. In this way, the operator can brace the chain saw on the thigh in order to make a safe cut.

According to another embodiment of the invention, the lug is latched free of play in its rest position so that vibrations occurring while the engine is running do not cause noise in the region of the lug. The latch device is advantageously defined by a latch nose fixedly mounted to the housing and projecting into the recess. The latch nose holds the lug against a stop provided on the base of the recess.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
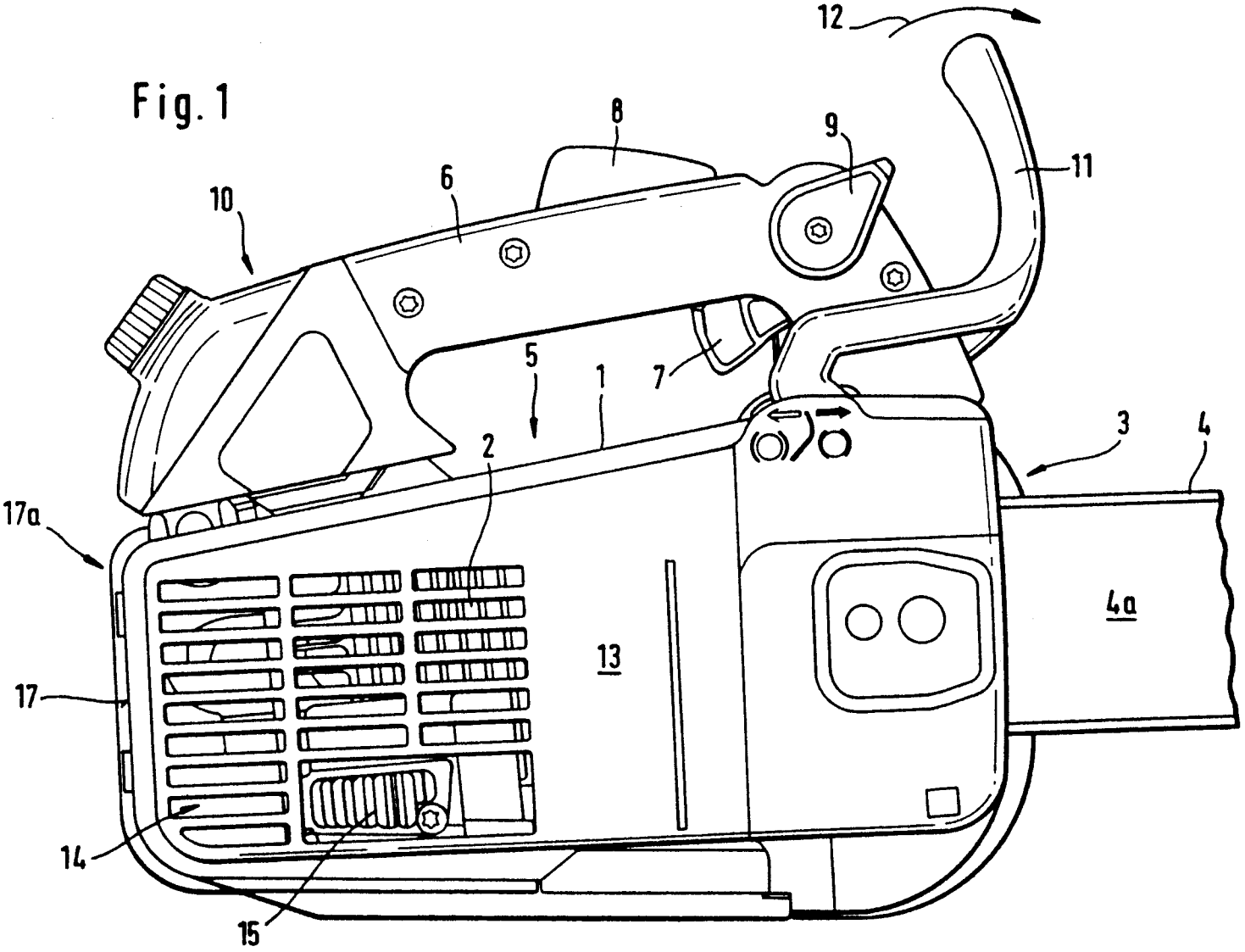
FIG. 1 is a side elevation view of a motor-driven chain saw according to the invention.

The portable handheld work apparatus shown in FIG. 1 is a motor-driven chain saw which is known as a top-handle chain saw because of its configuration. Motor-driven chain saws of this kind are used especially in the care of trees wherein an operator climbs into the trees to be cared for in order to perform the necessary work.

The motor-driven chain saw includes a housing 1 in which an internal combustion engine 2 is mounted. The engine drives a work tool mounted on the forward end face 3 of the housing. The work tool is a saw chain in the case of a motor-driven chain saw with the saw chain 4 being driven around the periphery of a guide bar 4*a*. The saw chain 4 is driven by a sprocket wheel mounted below the side housing cover 13. The guide bar 4*a* extends perpendicularly to the forward end face 3 of the housing and extends forwardly in the longitudinal direction of the chain saw.

A handle 6 is mounted on the top side 5 of the housing and is aligned in the longitudinal direction of the chain saw. The handle 6 includes a throttle lever 7 on the side of the handle facing toward the housing 1 and a throttle-lever latch 8 on the side of the handle facing away from the housing 1. The throttle lever 7 and the throttle-lever latch 8 are provided for controlling the drive motor 2 which, in the embodiment shown, is a two-stroke engine. An operating-mode selector 9 is provided in the forward region of the handle 6 which is easily controlled by the thumb of the hand holding the handle 6.

A carburetor space 10 is provided in the rearward section of the handle 6 in which a carburetor is mounted for supplying the engine with an appropriate air/fuel mixture. The carburetor draws the fuel from a fuel tank 17*a* which is integrated into the rearward region of the chain saw in the housing 1. The rearward outer wall of the fuel tank 17*a* simultaneously defines the rearward end face 17 of the housing 1 of the chain saw.

A front hand guard 11 is mounted transversely to the longitudinal direction of the motor-driven chain saw and is disposed forward of the handle 6. The front hand guard 11 is pivotally mounted and, when this handle pivots in the direction of arrow 12, a braking device mounted in the housing cover 13 is actuated to bring the drive sprocket to standstill whereby the saw chain 4 is brought to a stop within fractions of a second. The housing cover 13 laterally closes the housing 1 and includes an outlet opening 14 for passing the engine-cooling air. The outlet of the muffler 15 of the engine is also disposed in the outlet opening 14.

Figures 2, 5:
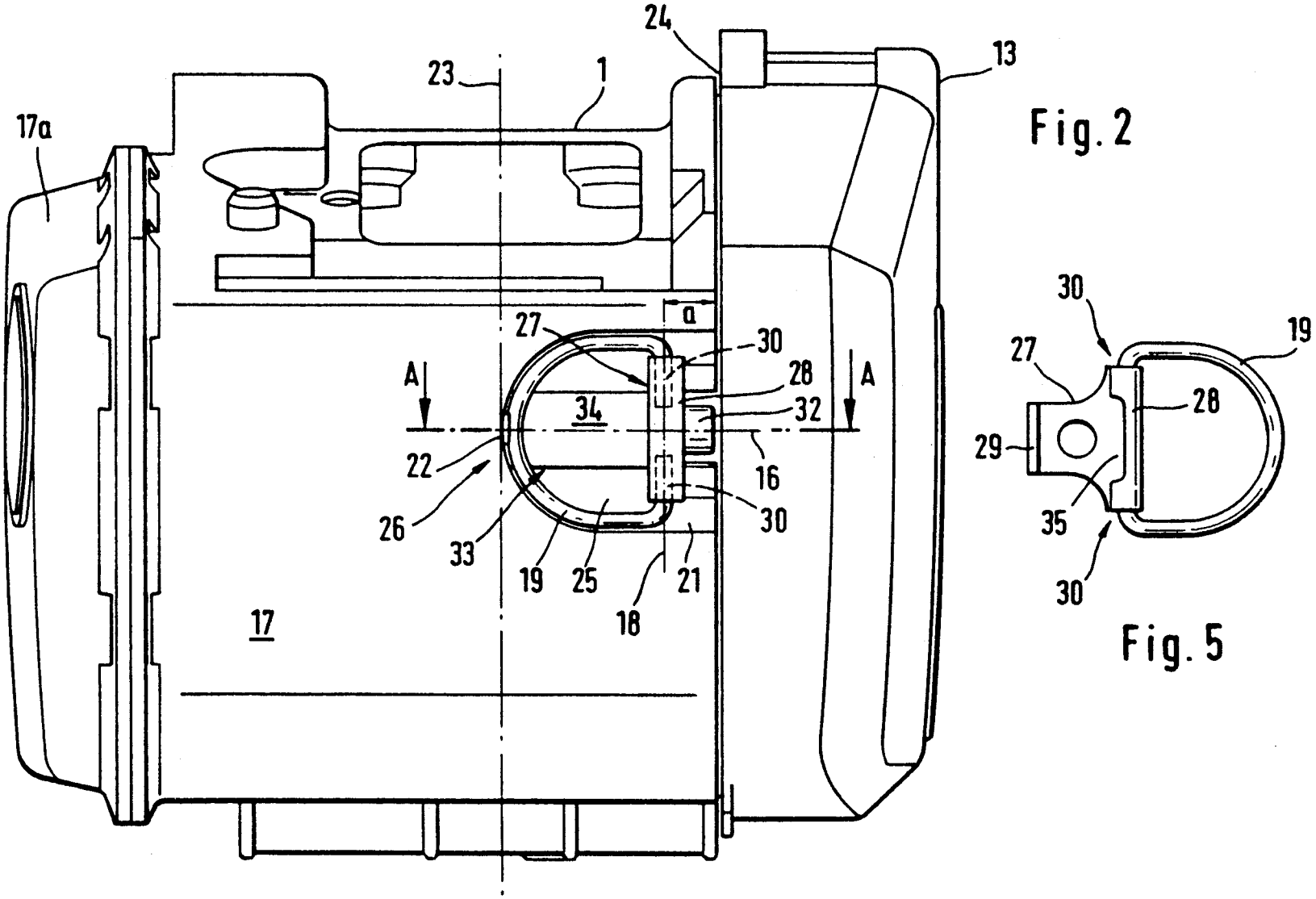
FIG. 2 is an elevation view of the rearward end face of the housing of the motor-driven chain saw of FIG. 1.
FIG. 5 is a plan view of the carrying or holding lug and lug holder.

As shown in the plan view of FIG. 2, a carrying lug 19 is mounted on the rearward housing end facing away from the work tool 4. The carrying lug 19 is pivotable about an axis 18 into its rest position (FIGS. 2 and 4) in the plane 20 of the rearward housing end face 17 and is held recessed in a recess 21.

As shown in FIG. 2, the recess 21 is configured so as to have a U-shape and is open toward the partition plane 24 which is conjointly defined by the housing 1 and the side housing cover 13. The longitudinal center axis 16 of the U-shaped recess 21 is perpendicular to the partition plane 24. The foot point 26 of the U-shaped recess lies on the plane 23 passing through the center of gravity. The plane 23 extends parallel to the partition plane 24 and contains the center of gravity of the chain saw.

The holding lug 19 is held by a T-shaped lug holder 27. The holding lug 19 corresponds in plan view to the shape of the receptacle, that is, to a U-shape. The free leg ends 30 are bent over inwardly and lie at a spacing to each other. It can be advantageous to weld the ends of the leg or to solder the same or to close the same in some other way. The ends of the leg engage axially from outside into a bearing section 28 of the lug holder 27. The bearing section 28 is defined by a transverse member of the lug holder 27.

The foot of the T-shaped lug holder 27 is the end 29 thereof facing away from the bearing section 28. This foot is bent over toward the plane **27*a* of the lug holder. The bearing section 28 and the end 29 both lie in common on one side of the plane 27*a* of the lug holder 27**.

The flat lug holder 27 is stamped from sheet metal and lies approximately in the partition plane between the housing 1 and the side housing cover 13 perpendicularly to the housing end face 17. The lug holder has a region lying between the bearing section 28 and the end 29. The lug holder lies with this region flat on an attachment base 31 which is formed in the housing 1 and projects into the fuel tank **17*a*. The lug holder 27 is fixed to the attachment base 31 by an attachment screw 32 lying perpendicularly to the partition plane 24. The end 29 of the lug holder 27 engages behind the attachment base 31. The bearing section 28 of the lug holder 27 projects into the recess 21 and closes this recess to the partition plane 24. The pivot axis 18 is defined by the leg ends 30 engaging into the bearing section 28. The pivot axis 18 of the holding lug 19 lies parallel to plane 20 of the housing end face 17 as well as parallel to the partition plane 24. The pivot axis 18 lies at a spacing (a) to the partition plane 24 and lies at a minimal spacing (b) to the plane 20** of the housing end face.

In the rest position shown in FIGS. 2 and 4, the holding lug 19 lies in the housing end face 17 barely below the plane 20 of the end face 17 in the recess 21. The holding lug 19 is latched in its rest position in order to prevent an unwanted pivoting of the holding lug 19 into its operating position shown in FIG. 3. For this purpose, a latching nose 22 fixed to the housing is provided and projects into the recess 21. In the embodiment shown, the latch nose 22 is mounted precisely at the foot point 26 of the U-shaped recess. The latch nose 22 is mounted at the edge of the recess 21 and slightly overlaps the holding lug 19 in the rest position thereby holding the lug in place in its rest position.

Figure 3:
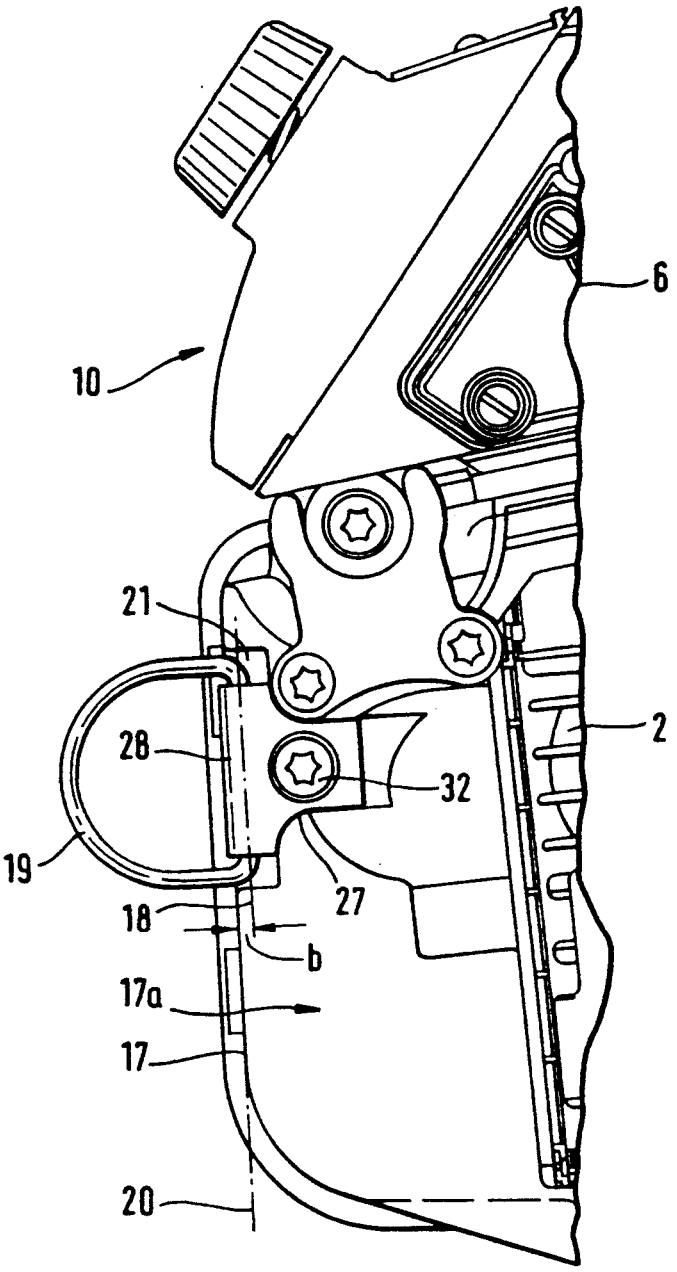
FIG. 3 is a detail view showing a portion of the motor-driven chain saw with the housing cover removed.

An elevated stop 33 for the holding lug 19 is provided on the base 25 of the recess in order to easily grab behind the holding lug to pivot the same into its operating position shown in FIG. 3. In the embodiment shown, the stop is configured as a strut 34 extending in the direction of the longitudinal center axis 16. The strut 34 is narrower than the bearing section 28 projecting into the recess 21. A cutout 35 (FIG. 5) is provided in the bearing section 28 between the axial ends. The strut 34 can engage into the cutout 35 when the strut extends over the entire length of the recess 21 as in the embodiment shown.

Figure 4:
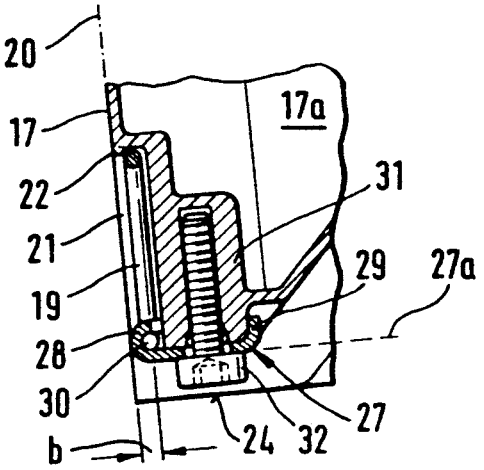
FIG. 4 is a detail section view taken along line A—A of FIG. 2.

In the rest position shown in FIGS. 2 and 4, the holding lug 19 is held without play between the strut 34 and the latch nose 22 so that no additional source of noise can be provided which is caused by vibration. Furthermore, the operator of the motor-driven chain saw can still continue in practice to support the housing end face 17 on the thigh since the holding lug 19 in its rest position does not disturb. In its operating position according to FIG. 3, the holding lug 19 lies approximately perpendicularly to the plane 20 of the rearward housing end face 17 so that adequate free space for hooking into a spring hook or passing a holding rope therethrough is provided. Carrying the motor-driven chain saw on the holding lug 19 is achieved without the motor-driven chain saw becoming tipped which would disturb manual movement since the attachment point of the lug holder 27 is in the vicinity of the plane 23 of the center of gravity.

The housing 1 as well as the housing cover 13 are made of plastic. The holding lug 19 and the lug holder 27 are made of metal.

Figure 7:
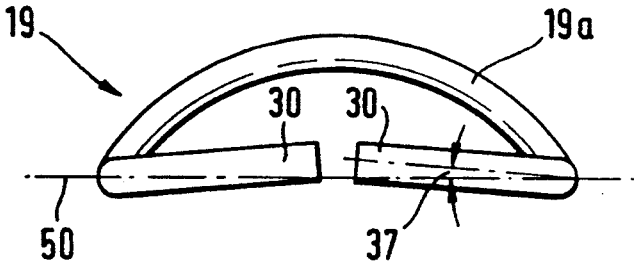
FIG. 7 is a view of the carrying lug of FIG. 6.
Figure 6:
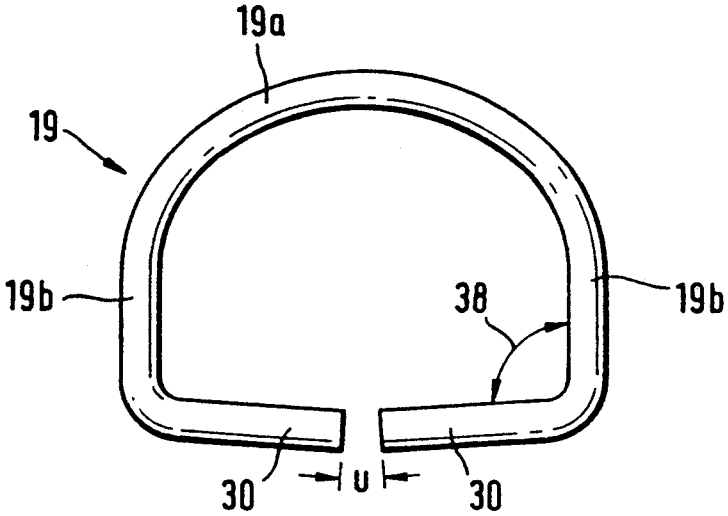
FIG. 6 is a plan view of a further embodiment of the carrying lug.
Figure 8:
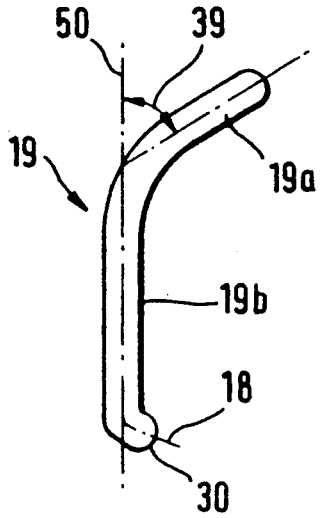
FIG. 8 is a side elevation view of the carrying lug of FIG. 6.

In another embodiment of the invention, the holding lug 19 is configured as shown in FIGS. 6 to 8. The holding lug 19 comprises two segments **19*b* lying parallel to each other with the segments 19*b* lying in a plane 50. The two segments 19*b* are connected to each other by an arc-shaped segment 19*a* which is bent out of the plane 50 of the holding lug 19. In the embodiment shown, the arc-shaped segment 19*a* is bent out by an angle 39 of approximately 60° from the plane 50. The free leg ends 30 of the U-shaped holding lug 19 configured in this manner are bent over toward each other as already described. Each of the free ends 30 and the segment 19*b* corresponding thereto conjointly define an angle 38** which is slightly greater than 90°. In the embodiment shown, this angle is approximately 95°.

The two leg ends 30 lie at a spacing (u) opposite each other. It can also be advantageous to connect the leg ends to each other. As shown in FIG. 7, the leg ends 30 are likewise bent out of plane 50 of the holding lug 19 at an angle 37 with the angle 37 being approximately 5° in the embodiment shown. The leg ends 30 are bent out to the same side as the arc-shaped segment **19*a* which contains the parallel segments 19*b* lying in the plane 50 of the holding lug 19**.

Figure 9:
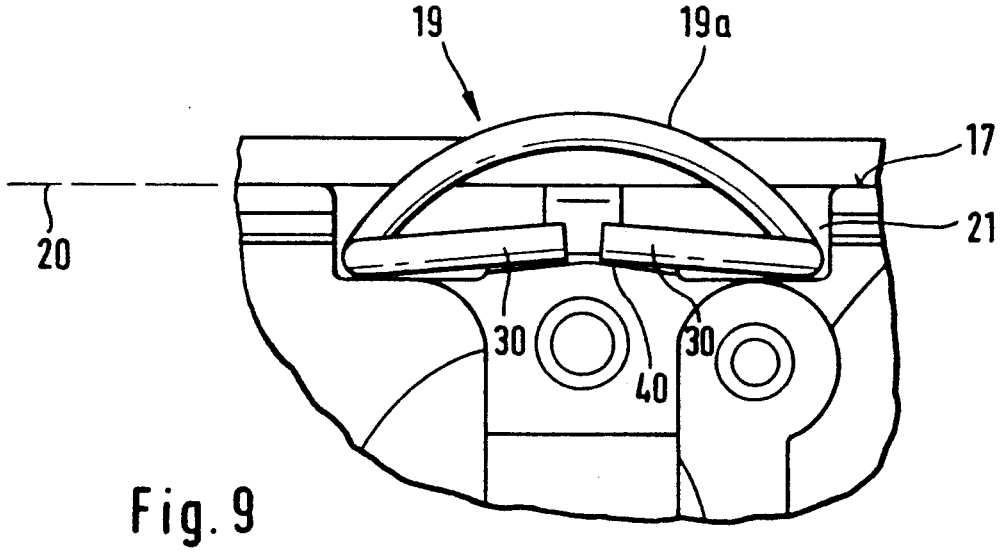
FIG. 9 is a detail view of the recess and the carrying lug positioned therein with the carrying lug being shown without the holder.

As shown in FIG. 9, the holding lug 19 is received in a recess 21 of the housing end face 17 with the arc-shaped segments **19*a* projecting from the recess 21 above the plane 20 of the housing end face 17. The arc-shaped segment 19*a* connects the segments 19*b* (FIG. 8) lying in the plane 50. The two leg ends 30 are fixed in a lug holder as already described above. The lug holder is not shown in FIG. 9** for reasons of clarity.

In the rest position shown in FIG. 9, the legs 30 lie on a roof-shaped surface 40 which corresponds to the bend angle 37 at which the legs 30 are bent up from the plane 50. The holding lug 19 is easily grasped because of its arc-shaped segment 19*a*. When the holding lug 19 is pivoted out of its rest position shown in FIG. 9 into an operating position, then, because of the pivot movement and the support 40, the legs 30 are pushed back elastically in the sense of a reduction of the angle 38 to return to their start position. In this way, the rest position and the operating position of the holding lug are fixed in the manner of a snap link so that without further measures, the particular position of the holding lug 19 can be assumed permanently.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus comprising:

a housing having a forward end wall, a rearward end wall defining a plane and a top wall extending between said end walls;

a handle mounted on said top wall for holding and guiding the work apparatus;

a drive motor mounted in said housing;

a work tool arranged at said forward end wall;

a holding lug to permit holding the work apparatus by an operator;

recess means in said rearward end wall for receiving said holding lug therein;

pivot means for pivotally mounting said holding lug on said rearward end wall so as to be pivotable about a pivot axis between a rest position wherein said holding lug is recessed in said recess means at least largely below said plane and an in-use position outside of said recess means;

latching means for latching said holding lug in said rest position; and, said latching means being a latch nose fixedly mounted on said rearward end wall so as to project into said recess for latchingly holding said holding lug in said rest position.

2. The portable handheld work apparatus of claim 1, further comprising latching means for latching said holding lug in said rest position.

3. The portable handheld work apparatus of claim 2, said work apparatus having a center of gravity contained in a gravity center plane; said housing having a lateral side; and, said work apparatus further comprising a side cover mounted at said lateral side; said side cover and said housing conjointly defining a partition plane parallel to said gravity center plane; and, said recess means being disposed between said partition plane and said gravity center plane.

4. The portable handheld work apparatus of claim 3, said recess means being a recess open at said partition plane.

5. The portable handheld work apparatus of claim 3, said recess means being a recess formed in said rearward end wall and defining a longitudinal axis approximately perpendicular to said partition plane; and, said recess being a U-shaped recess when viewed in plan on said rearward end wall.

6. The portable handheld work apparatus of claim 5, said U-shaped recess having two leg segments and a connecting segment interconnecting said leg segments and said U-shaped recess having a foot point on said gravity center plane.

7. The portable handheld work apparatus of claim 6, said latch nose being disposed at said foot point.

8. The portable handheld work apparatus of claim 5, said recess having a base and having a raised stop formed on said base for receiving said holding lug thereagainst in said rest position thereof.

9. The portable handheld work apparatus of claim 8, said stop being configured as a wide strut extending approximately perpendicularly to said partition plane and over the length of said recess.

10. The portable handheld work apparatus of claim 5, said pivot means comprising a lug holder mounted on said housing so as to be perpendicular to said rearward end wall; said lug holder being disposed approximately in said partition plane and having bearing means formed thereon to define said pivot axis; and, said bearing means being adapted to pivotally journal said holding lug therein.

11. The portable handheld work apparatus of claim 10, said bearing means being a bearing section formed on said lug holder so as to project approximately to said plane defined by said rearward end wall; and, said bearing section defining said pivot axis so as to be parallel to said plane defined by said rearward end wall.

12. The portable handheld work apparatus of claim 11, said recess having a base and having a raised stop formed on said base for receiving said holding lug thereagainst in said rest position thereof; said stop being configured as a wide strut extending approximately perpendicularly to said partition plane and over the length of said recess; said bearing section having axial ends and having a cutout formed therein so as to extend between said axial ends; and, said cutout having a width corresponding to the width of said strut.

13. The portable handheld work apparatus of claim 12, said lug holder having an end facing away from said bearing section and said work apparatus further comprising an attachment base formed in said housing and being disposed approximately perpendicular to said partition plane; and, said lug holder being mounted on said attachment base so as to engage behind said attachment base.

14. The portable handheld work apparatus of claim 13, further comprising a screw for holding said lug holder on said attachment base and said screw lying perpendicularly to said partition plane.

15. The portable handheld work apparatus of claim 12, said holding lug being U-shaped when viewed in plan and two free leg end portions bent over inwardly for pivotally engaging respective ones of said axial ends of said bearing section.

16. The portable handheld work apparatus of claim 15, said U-shaped holding lug having two mutually parallel leg segments terminating in said two free leg end portions, respectively, said two free leg end portions being bent upwardly out of said plane defined by said holding lug; and, said two free leg end portions defining respective angles of more than ninety degrees with corresponding ones of said leg segments.

17. The portable handheld work apparatus of claim 16, said recess means further including supports formed on said base of said recess for receiving said free leg end portions thereon when said holding lug is in said rest position; and, said supports being tapered to correspond to said angles, respectively, at which said two free leg end portions are bent upwardly out of said plane defined by said holding lug.

18. The portable handheld work apparatus of claim 17, said two leg segments being connected to each other by said opposite lying segment, said two free leg end portions being bent out of said plane defined by said holding lug in the same direction as said opposite lying segment extends out of said plane defined by said holding lug.

19. The portable handheld work apparatus of claim 1, said holding lug defining an eyelet for passing a holding rope therethrough to facilitate carrying the work apparatus by an operator.

* * * * *